United States Patent [19]

Giessen

[11] Patent Number: 4,540,546

[45] Date of Patent: Sep. 10, 1985

[54] METHOD FOR RAPID SOLIDIFICATION PROCESSING OF MULTIPHASE ALLOYS HAVING LARGE LIQUIDUS-SOLIDUS TEMPERATURE INTERVALS

[75] Inventor: Bill C. Giessen, Cambridge, Mass.

[73] Assignee: Northeastern University, Boston, Mass.

[21] Appl. No.: 558,612

[22] Filed: Dec. 6, 1983

[51] Int. Cl.[3] ..... C22C 1/02; C21C 5/56

[52] U.S. Cl. ..... 420/590; 75/0.5 C; 75/129; 148/3; 164/463; 264/8

[58] Field of Search ..... 75/129, 123 T, 0.5 C; 420/590; 148/440, 438, 437, 436, 435, 432, 429, 425, 431; 264/83; 164/463

[56] References Cited

U.S. PATENT DOCUMENTS 3,194,656 7/1965 Vordahl ..... 420/590

OTHER PUBLICATIONS

Grant, N. J. et al, "Liquid Metal Atomizations for Hot Working Preforms", *Solidification Technology,* 1972, pp. 317–336.

Lawley A., "Fundamentals of Particulate Metallurgy", *Advances in Metal Processing,* 91–109, ©1981, Plenum Press.

*Primary Examiner*—L. Dewayne Rutledge

*Assistant Examiner*—Christopher W. Brody

*Attorney, Agent, or Firm*—Weingarten, Schurgin, Gagnebin & Hayes

[57] ABSTRACT

Rapid solidification processing by liquid quenching is made practical for multiphase alloys having relatively large liquidus-solidus temperature intervals by a new processing technique termed "melt mix reaction" involving chemically reacting two starting alloys in a mixing nozzle in which a melt mix reaction takes place between the chemically reactable components of the starting alloys to form submicron particles of the resultant compound in the final alloy. The mixing and chemical reaction is performed at a temperature which is at or above the highest liquidus temperature of the starting alloys but which is also substantially below the liquidus temperature of the final alloy, and as close to the solidus temperature of the final alloy as possible. Rapid solidification may be accomplished through the utilization of a melt spinning wheel or may be accomplished through the utilization of an atomizing nozzle configuration, with the rapidly solidified alloy containing a matrix with a microdispersion or a precipitate of the resulting compound contained therein. Heat treatment of the rapidly solidified final alloy may be additionally employed to produce precipitate hardening of the final alloy should such microdispersed precipitates not be formed or be formed incompletely during the rapid solidification process.

42 Claims, 14 Drawing Figures

METHOD FOR RAPID SOLIDIFICATION PROCESSING OF MULTIPHASE ALLOYS HAVING LARGE LIQUIDUS-SOLIDUS TEMPERATURE INTERVALS

FIELD OF INVENTION

This invention relates to rapid solidification of alloys and more particularly to the rapid solidification of alloys having large liquidus-solidus temperature intervals.

BACKGROUND OF THE INVENTION

Among other benefits, rapid solidification processing (RSP) allows the preparation of alloys in a desirable form of macroscopically homogeneous, fine-crystalline material in which micron or submicron crystal particles are contained in a matrix to provide improved properties. However, sufficiently rapid solidification often cannot be achieved when attempting to melt and quench complex multiphase alloys to produce submicron particles. This is the case especially when the solidification process takes place over too long a time. The particles to be formed in the matrix will then often grow to such a size that they are no longer useful in producing improved properties. This may occur because the temperature drops at too low a rate or because the solidification temperature interval is relatively large. Thus, the major reason for the inability to rapidly solidfy multiphase alloys coming from the phase diagram of the alloy is a relatively large difference in liquidus and solidus temperatures for the alloy. The problem in rapidly solidifying such alloys is that relatively large particles tend to grow because the temperature of the alloy must be dropped through the entire liquidus-solidus temperature interval prior to reaching the temperature where solidification is complete. Because in the prior art the cooling starts at the liquidus temperature of the final alloy, not only is the solidus-liquidus interval large, allowing large particles to form on cooling, but also the effective cooling rate at each temperature of the liquidus-solidus interval is reduced, again contributing to the growth of relatively large particles.

More specifically, the products of the solidification process in a multiphase alloy are dependent on the rates of nucleation and growth of the constituents. Through their effect on the relative rates of crystal nucleation and growth, two factors can be considered to control the number and size of dispersoid particles growing in the melt: First, the effective cooling rate at a given temperature and, second, the temperature interval between start and completion of the solidification process which, in the absence of appreciable supercooling, is close to the solidus-liquidus temperature interval. These two factors may be combined qualitatively by defining a cooling period during which the solidification process of the dispersoid phase proceeds. While, within limits, the cooling rate is controllable, the solidus-liquidus temperature interval is given for each alloy system, and may be unfavorable for microdispersion formation.

Since in the absence of supercooling, initial solidification takes place quite close to the liquidus temperature of an alloy, it is not possible to achieve an effective cooling rate of $10^4$–$10^6$ °K./sec, typical of rapid solidification processing and a short cooling period in the case where the liquidus-solidus interval is large as compared to the liquidus temperature. For instance, with $\Delta T = T_L - T_S$, where $T_L$ is the liquidus temperature of the final alloy and $T_S$ is the solidus temperature, if $\Delta T/T_L$ is large, e.g. greater than 0.2, then neither a high effective cooling rate nor a short cooling period can be achieved. If a high effective cooling rate and a short cooling period cannot be achieved, then dispersoid constituents in the alloy grow above a submicron particle size as they grow and agglomerate during the relatively slow and lengthy cooling process. These large grown or agglomerated particles are thereafter relatively useless in providing improved properties, one of which is dispersion strengthening of the final alloy.

For example, it will be appreciated that dispersion strengthening requires a fine microdispersion of particles within a matrix in which the average diameters of the particles within the matrix are to be in the submicron range and desirably in the 10 nanometer of 0.1 micron range. Thus, with alloys having large liquidus-solidus temperature intervals, assuming the multiphase alloy is prepared ahead of time and then melted to form a single liquid solution, the resulting dispersoids in the alloy grow to such large size during rapid solidification that they do not form a submicron dispersion (microdispersion) in the final product.

By way of background, a method for the treatment of liquid metals described in U.S. Pat. No. 4,279,843 to N. Suh discusses a process in which two streams of liquid metals are made to impinge upon each other, with the result that eddys of one liquid form in the other. As described in this patent, if the temperatures are chosen properly, small particles of one stream of material will form and solidify in the stream of the other material which acts as a coolant. It will be appeciated that while this patent describes mixing of liquid alloy streams, there is no chemical reaction between any of the components.

As described by E. F. Caldin, "Fast Reactions and Solutions," Wiley, New York, 1964, a second prior art technique is the so-called "stop-flow" method which is extensively used in inorganic chemistry to measure fast reactions. In this process, two fluids are rapidly mixed by injection into a mixing tube and the ensuing solution reaction is monitored, usually by spectrometry. Here no reference is made to alloys having large liquidus-solidus intervals or any resultant product.

Reference is also made to U.S. Pat. No. 4,356,133 in which a reactant medium is transported across the surface of a body rotating at high speed and is discharged therefrom by centrifugal force. A chemical reaction is caused to occur in the medium after the discharge while the reactant medium is still connected to the surface of the body. While this patent indicates travelling chemical reactions, the patent is silent about the utilization of the process for rapidly solidified alloys, much less alloys having large liquidus-solidus intervals.

Further, U.S. Pat. No. 4,257,830 illustrates a number of different melt spinning processes including various nozzle configurations, there being no melt mixing to form a chemically reacted product.

Finally, U.S. Pat. No. 4,339,255 shows a method for forming a metallic dielectric or semiconductor modified amorphous glass material, e.g. a single phase material, which includes the steps of forming a fluid host matrix material on a substrate surface having relative movement thereto, such as a wheel, directing a fluid modifier material in a stream, as from a nozzle, towards a substrate surface in a direction such that it converges with the host matrix material while at the same time maintaining the temperature of the substrate or wheel between 4.2° Kelvin and ambient room temperature while rotating the wheel at a velocity of 1,000 to 5,000 r.p.m. to obtain a surface velocity of between 1,000 to 4,000 centimeters per second for obtaining a rapid quenching of the host and modifier material as they contact one another at a rate of from $10^4$ to at least $10^8$ °C. per second or more to produce a ribbon of modified amorphous glass material. It will be appreciated that in this patent the goal is the formation of a homogenous material, and not a heterogenous material for improved mechanical, magnetic, and/or electrical properties. What is produced in this patent is an amorphous material in the form of a homogeneous single phase material in which no second phase has begun to form. That is to say, no locally heterogenous material is formed, whether or not as a dispersoid. This patent does not envisage the final product having anything other than a homogenous structure, unlike precipitates which can produce improved mechanical, chemical and electrical properties. Moreover, any chemical reaction which could take place, would take place in free space which is extremely difficult to control and is therefore undesirable. Moreover, the advantage of melt mixing with respect to multiphase alloys having large liquidus-solidus temperature intervals is not discussed in this patent.

SUMMARY OF THE INVENTION

In order to be able to produce microdispersions in rapidly solidified multiphase alloys having large liquidus-solidus temperature intervals, a melt mix reaction (MMR) process is used which includes liquid jets of starting alloys having chemically reactable components in the form of solutes which are mixed together in a mixing chamber defining a mixing zone such that a liquid mixture forms in the mixing zone containing the reactive components in a common solvent or liquid matrix material. It is not important that the reactive components chemically react in the mixing zone to form a compound, as they may react either in the mixing zone, in a nozzle provided at the mixing chamber, after nozzle exit or even in a subsequent annealing step. It is however important that the mixing time be as short as possible to minimize the time that particle size can grow. Moreover, mixing time should be long enough to provide complete mixing. Mixing time can be shortened by efficient mixing zone design for maximum turbulent mixing. In one embodiment, the chemical reaction starts in the mixing zone and is allowed to continue in a nozzle. By chemical reaction is meant a liquid or solid state reaction in which new chemical entities are formed which may range in size from molecular through crystal embryos or aggregates to crystallites.

The combined dwell time in the mixing zone and nozzle determines the ultimate size of the chemically reacted constituent, the compound, in the final alloy, with the shorter the dwell time in the mixing zone and nozzle the smaller the particle constituents that are formed.

In one embodiment, the starting alloys have a common solvent base. However, a common solvent base is not necessary, the only requirement being that the final alloy have a common solvent base, for example, a solid solution of nickel in cobalt, Co(Ni). However, for ease of description, the starting alloys can be characterized as having a common solvent base C such that the starting alloys are characterized as C+A and C+B, in which C is a solvent and A and B are the solutes to be chemically reacted. The chemical reaction in the mixing zone results in an alloy C+AB, with component A reacting chemically with component B to form an AB constituent in the final alloy. Here AB is used to refer to compounds of the general composition $A_xB_y$.

It is the purpose of the combination of melt mix reaction and rapid solidification to provide a microdispersion of AB particles in solvent C, whether the rapid solidification is accomplished by utilization of a melt spinning wheel, by atomization nozzles, or by other rapid solidification techniques. In an optimal step, the final alloy may be heat treated so that any unprecipitated AB constituent will precipitate out in the solvent matrix, thereby to provide precipitation hardening, other mechanical strengthening, or other desirable properties for the resulting alloy.

An important feature of the above process is that the mixing temperature, $T_{mix}$, is substantially less than the liquidus temperature of the final alloy C+AB. The mixing temperature, $T_{mix}$, is desirably maintained as close to the solidus temperature of the final alloy as possible so that the solvent plus the chemically reactive solute components can be rapidly cooled from $T_{mix}$, as opposed to being cooled from the substantially higher liquidus temperature of the final alloy. Particle formation is thus constrained to occur only over a smaller temperature interval and shorter cooling time period than would have been the case if cooling started at the higher liquidus temperature. As a result, the ultimate size of the constituent particles can be limited to be smaller than that which would result without the melt mix reaction process. In one example, the liquidus temperature of the final alloy C+AB may be as high as 1,000° C., whereas the solidus temperature may be as low as 600° C. Here $\Delta T=400°$ C. and $T_L=1{,}000°$ C.+273. Thus, $\Delta T/T_L=0.31$. For alloys having $\Delta T/T_L$ greater than 0.20 relatively large particles tend to grow even for rapid solidification processing. In the above example, maintaining the mixing temperature at, for instance, 650° C. results in the final alloy being rapidly solidified from a temperature of 650° C. as opposed to 1,000° C. Starting at 650° C. results in a reduced cooling time between 650° C. and the solidus temperature as compared to the dwell time on cooling from 1,000° C. to the solidus temperature. For example, the effective cooling time starting at 650° C. is 50 microseconds for a cooling rate of $10^6$ degrees Kelvin per second as opposed to an effective cooling time of 4 milliseconds if the material were to be taken from 1,000° C. down to the solidus temperature according to the prior art process. This desirable reduction of the cooling time by a factor of approximately 80 in the MMR process has two causes. The first of these is the reduction of the liquidus-solidus interval from 400° C. to 50° C., i.e. by a factor of 8. The second is an increase of the effective cooling rate in the shortened temperature range of solidification by at least an order of magnitude, as compared to the prior art process which starts at the relatively higher liquidus temperature $T_L$ of the final alloy. Thus, the result of shortening the cooling interval in MMR processing is a reduction of the cooling time by a factor of about 80 compared to the prior art process. Taken together with the lower temperature $T_{mix}$ at which the solidification process starts, and the concomitant increase of melt viscosity and hence decrease of growth rate, this reduced cooling time prevents large precipitate particles from forming. Such relatively large precipitate particles would be formed if, for instance, the final alloy were premixed and then melted at the liquidus temperature, from which the cooling would proceed. As mentioned before, large precipitate particles are not as useful in providing improved characteristics as the smaller particles achievable by the subject process.

The mixing temperature is set at or above the highest of the liquidus temperatures of the two starting alloys. Thus, for instance, if the liquidus temperature of the alloy C+A is 600° C. and that of alloy C+B is 650° C., then $T_{mix}$ must be set at or above 650° C.

The above process depends primarily on the ability to mix the two starting alloys rapidly relative to the speed of the chemical reaction at the mixing temperature. This ratio determines the amount of particle formation and growth prior to rapid solidification.

While it is essential that substantially complete mixing take place in the mixing zone so that the resulting alloy be free from macroscopic inhomogeneity and so that the chemical reaction can proceed, it is not necessary that the chemical reaction be completed in the mixing zone. In one embodiment, a nozzle extends the mixing zone, with the length of the nozzle below the mixing zone determining the length of time that the reacting components are together. For relatively long nozzles, temperature control is important to preclude freezing in the nozzle. The time spent by the reacting materials in both the mixing zone and in the nozzle is referred to as the "dwell time" and the nozzle length in part determines the dwell time and thus the final size of the particles of the reacted constituent of the final alloy. For relatively slow chemical reactions, the nozzle is maintained at $T_{mix}$ to prevent freezing of the alloy in the nozzle during the time that the chemical reaction takes place. As the chemical reaction takes place, particles of the reacted solutes are produced which grow in size. It is therefore desirable to limit the length of the nozzle to prevent the particles of the reacted solutes from achieving a size greater than 10 microns. However, the desired diameter of the growing or agglomerating particles of the chemically reacted components forming the constituent is in the range of 10 nanometers to 0.1 microns.

After mixing, the fully mixed and either fully or partially chemically reacted constituent in the solvent leaves the nozzle and is directed, in one embodiment, towards a melt spinning wheel to produce a rapidly solidified ribbon. Very little growth of the reacted constituent occurs in free air or in the ambient atmosphere. Upon contact with the melt spinning wheel, the chemical reaction is stopped and no further growth of the reacted constituent particles can occur. Should the particles not be completely formed during rapid solidification, subsequent heat treatment or annealing at, for instance, 300° C. for two hours of the ribbon formed on the melt spinning wheel results in a further chemical reaction forming a microdispersed precipitate within the solvent matrix. The subsequent heat treatment is desirable should the rapid solidification process not produce the required precipitate in the solvent matrix.

In an alternative embodiment, submicron precipitates of the chemically reacted constituent can be achieved though the utilization of an atomizing system in which a stream of the alloy is atomized by gas jets to form fine particles containing the chemically reacted constituent in the solvent. The particulate stream is emitted into a nonreactive atmosphere (H, He, Ar, N) or a cooling fluid in either of which the cooling is accomplished by radiation and convection.

Typical melt mix reaction micro-alloys, including the chemical reactions forming these alloys, are listed below in Table I.

TABLE I: REPRESENTATIVE MMR ALLOYS

Al:
- $Al(Si)+Al(Mg)\rightarrow Al+Mg_2Si$
- $Al(Ti)+Al(B)\rightarrow Al+TiB_2$
- $Al(Ti)+Ni(B)\rightarrow Al+Al_3Ni+TiB_2$
- $Al+Cu(O)\rightarrow Al(Cu)+Al_2O_3$
- $Al+Ni(O)\rightarrow Al+Al_3Ni+Al_2O_3$ Cu:
- $Cu(Al)+Cu(O)\rightarrow Cu+Al_2O_3$
- $Cu(Al)+Ni(O)\rightarrow (Cu,Ni)+Al_2O_3$
- $Cu(Si)+Cu(O)\rightarrow Cu+SiO_2$
- $(Cu,Ni)(Nb)+Cu(Ge,Al)\rightarrow Cu(Ni)+Nb_3(Ge,Al)$ Ni:
- $Ni(Al)+Ni(O)\rightarrow Ni+Al_2O_3$
- $Ni(Al)+(Ni,Cu)(O)\rightarrow (Ni,Cu)+Al_2O_3$
- $Ni(Th)+Ni(O)\rightarrow Ni+ThO_2$
- $Ni(Y)+Ni(O)\rightarrow Ni+Y_2O_3$
- $Ni(B)+Ni(Mo)\rightarrow Ni+Mo_xB$
- $Ni(B)+Ni(Ti)\rightarrow Ni+TiB_2$
- $Ni(Al)+Ni(Nb)\rightarrow Ni+Nb_3Al$ Co:
- $Co(C)+CO(W)\rightarrow Co\rightarrow WC$
- $Co(C)+Co(Mo)\rightarrow Co+MoC$ Fe:
- $Fe(C)+Fe(Mo,W)\rightarrow Fe+(Mo,W)C$ Ag:
- $Ag(Cd)+Cu(O)\rightarrow Ag(Cu)+CdO$
- $Ag(Bi)+Cu(O)\rightarrow Ag(Cu)+Bi_2O_3$ Pb:
- $Pb(Sb)+Pb(In)\rightarrow Pb+InSb$ Si:
- $Si(Th)+Si(O)\rightarrow Si+ThO_2$ In this Table, A(B) indicates a liquid solution of B in A or, after solidification, a solid solution of B in A; (A,B) indicates a liquid or solid solution where A and B are both present at sufficiently high concentrations such that either A or B can be considered as the solvents or solute.

A particularly important class of dispersion strengthened systems can be characterized as $(metal_1)$-$(solute_1)+(metal_2)(solute_2)$, where $Metal_1$ is taken from the group: Cr, Mn, Fe, Co, Ni, Cu, Ru, Rh, Pd, Ag, Os, Ir, Pt, Au, etc.

$Solute_1$ is one or more of metals or metalloids capable of forming stable compound with metalloids from $solute_2$ such as, Be, Mg, Ca, Y, rare earth metals, Th, Ti, Zr, Hf, V, Nb, Ta, Mo, W, Re, Al and the like, or the metalloids B, Si, and the like.

$Metal_2$ is one or more of metals possessing sufficient liquid solubility for $solute_2$ such as Cr, Mn, Fe, Co, Ni, Cu.

Solute 2 is one or more of the compounds forming metalloids B, C, Si, N, P, Sb, O, S. Preferred among these combinations are those where $solute_2$ is oxygen, such that oxides such as $Al_2O_3$, $SiO_2$, etc. form with the appropriate $solute_1$ elements Al, Si, respectively.

Also it will be appreciated that certain elements such as B or Si are present in both groups, $solute_1$ and $solute_2$. When they are present as $solute_1$ elements, they will form compounds with certain $solute_2$ elements such as oxygen or nitrogen, whereas where they are present as solute$_2$ elements, they will form compounds with certain solute$_1$ elements such as Be, Mg, Ti, etc.

While some of the above listed alloys can be produced by conventional rapid solidification processing, the alloys thus produced tend to have coarsened particles due in part to either relatively large cooling times or relatively lower cooling rates associated with freezing without using the melt mix reaction process. All of the above listed alloys, when prepared in accordance with the subject melt mix reaction process exhibit enhanced characteristics both in terms of reduced particle size and ease of manufacture.

Where the reactive solute$_2$ metalloid is oxygen, it may be necessary to take special precautions to maintain the required concentration of oxygen in the solution, e.g, for Cu(O) or Ni(O), by keeping the solution under a predetermined partial pressure of oxygen. Corresponding precautions may be needed if solute$_2$ is nitrogen or phosphorus.

Also, either of the two solutes may be present in the corresponding liquid alloy in the form of a molten stoichiometric or nonstoichiometric compound rather than as a dilute liquid solution based on the solvent. An example is oxygen in copper which may be present as molten $Cu_2O$ or CuO as well as Cu(O) which indicates a dilute liquid solution of oxygen in copper.

The melt mix reacted micro-alloys, especially those containing an oxide constituent, have potential applications as dispersion strengthened alloys for elevated temperature service. These include alloys of aluminum, iron, cobalt, copper and nickel base and include $Al_2O_3$ and $SiO_2$ as dispersoids. Other MMR alloys have potential application where wear resistance is paramount, such as for tool bits utilizing the borides or carbides. Dispersion strengthened corrosion resistant alloys having a copper-nickel base are also produced by the above melt mix reaction technique. Electrical contact materials having Ag bases are within the scope of this invention, as are ductile superconductors based on $Cu+Nb_3$-(Ge,Al), which were previously made by expensive extrusion processes. Magnetic materials, bearing materials such as Cu-Sn based alloys, metal-ceramic composites, and ceramic composites can also be made by the melt mix reaction process. Finally, dispersion strengthened metallic glasses and dispersion strengthened supersaturated solid solutions are included as potential applications.

In summary, it is the object of the present invention to prepare microdispersions of relatively high melting particles in relatively lower melting matrices. This is accomplished through the rapid mixing of starting alloys having reactive components, with the mixing being accomplished at a temperature below the liquidus temperature of the final alloy, and with the mixing being followed by quenching. Turbulent rapid mixing of two liquid jets prior to ejection from a nozzle onto a quenching wheel or through an atomizing orifice, produces the requisite alloy which is rapidly quenched without cooling through the entire liquidus-solidus temperature interval. Heat treatment of the rapidly solidified product may be utilized to complete the chemical reaction and precipitation process. Thus, in the present approach, two liquid streams are rapidly mixed at a temperature below the liquidus temperature of the final alloy. These liquids utilize the same or differnt matrix materials as solvents and contain the components of the desired chemical reaction as solutes. Following a brief period of mixing of the solutes, the liquid stream is rapidly quenched by melt spinning or atomization to terminate the reaction and to prevent precipitate particle agglomeration and/or coarsening.

Apparatus required includes devices suitable for rapid turbulent mixing of the two liquid jets, for careful timing of the period of flow through the nozzle, if used, and a quenching wheel or an atomizing orifice. In some cases, a low temperature heat treatment of the product may be required to produce an ultrafine precipitate or to further beneficiate the alloy.

While the above discussion has centered on the possibility of obtaining microdispersions through the utilization of a melt mix reaction due to either the increased effective cooling rate or the decreased cooling time interval associated with the melt mix reaction, the melt mix reaction also has application where the crucible material, mixing zone material and/or nozzle material have upper temperature limits of utility. For instance, if silica crucibles are utilized, the processing temperature must be maintained below 1,400° C. However, for microdispersed alloys, it may be that the final alloy has a liquidus temperature well in excess of the softening or melting temperature of silica which would ordinarily preclude the utilization of a silica crucible, either because of its softening or because of an undesired chemical reaction between the melt and the crucible. However, by proper selection of the starting alloys, it is possible to reduce $T_{mix}$, the processing temperature, to below the softening, melting, or reaction temperature of silica, thereby permitting the utilization of non-exotic, less expensive crucible materials such as silica as compared to refractory oxides such as beryllia, zirconia, thoria or the like. In this manner, the subject melt mix reaction process can accommodate alloys having liquidus temperatures which are otherwise incompatible with the apparatus materials as well as accommodating alloys which are otherwise incompatible with the formation of microdispersions by rapid solidification processes. The incompatability comes from either the inability to form microdispersions at all, or the inability to form microdispersions by conventional apparatus. In some instances, special rapid solidification devices such as melt spinning or atomization may not be required to obtain the desired constituent configurations, if less severe rapid solidification processes, such as continuous casting into thin sheets, canproduce the desired results.

BRIEF DESCRIPTION OF THE DRAWINGS

These and other fetures of the subject invention will be better understood in connection with the detailed description taken in conjunction with the drawings of which.

DETAILED DESCRIPTION OF THE DRAWINGS

As mentioned, the difficulties in providing dispersoid strengthened alloys from multiphase alloys having large liquidus-solidus temperatures arises from the magnitude of the liquidus-solidus temperature interval of the alloy which can be as much as 400° C. or more. When such alloys are rapidly solidified, the starting temperature for the rapid solidification is the relatively high liquidus temperature. The rapid solidification proceeds from the relatively high liquidus temperature to and through the lower solidus temperature piror to achieving the final temperature which may either be ambient room temperature or as low as 4° Kelvin. Useful alloys having large liquidus-solidus temperature intervals include the general class of alloys in which a solvent matrix includes a compound which is to be finely dispersed within the matrix in precipitate form to provide improved properties for the final alloy.

As will be discussed, merely preparing the final alloy and melting it prior to rapid quenching is insufficient to provide a submicron dispersoid of the compound in the solvent during rapid solidification in which the solvent forms a matrix for the dispersoid.

Figure 1:
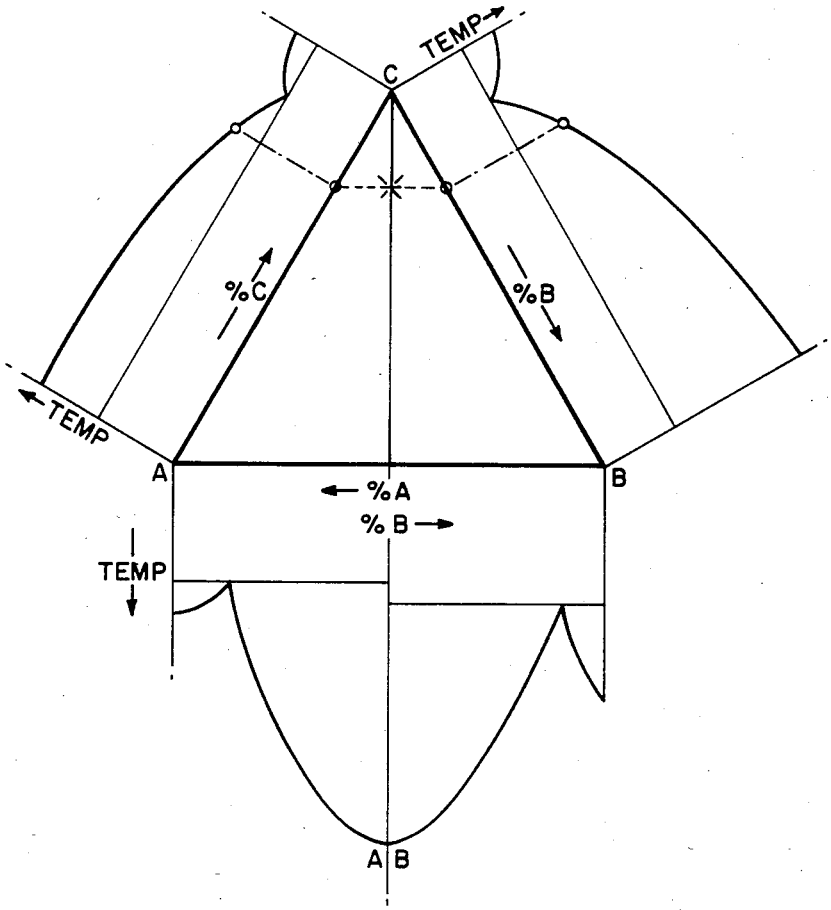
FIG. 1 is a ternary composition diagram showing a ternary alloy system A-B-C characterized by two binary eutectic systems A-C and B-C and a binary system A-B containing a relatively high melting compound AB.

Referring to FIG. 1, a ternary composition diagram is shown for a system formed by three constituents, A, B, and C. The three limiting binary systems A-B, B-C, and A-C are shown folded into the plane of the composition triangle A-B-C. The three limiting binary phase diagrams are of the following types:

A-C and B-C are simple eutectic phase diagrams while the system A-B shows an alloy phase AB having a melting point substantially higher than those of either constituents A or B.

Figure 2A:
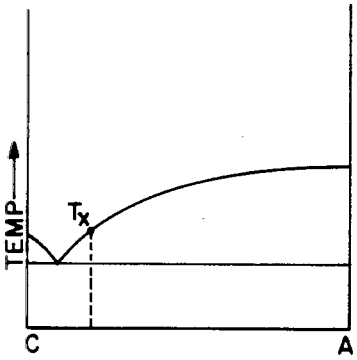
FIGS. 2A, 2B and 2C are the individual phase diagrams for the binary systems and the pseudobinary system C-AB of FIG. 1.
Figure 2B:
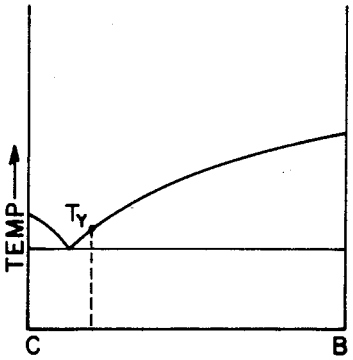
Figure 2C:
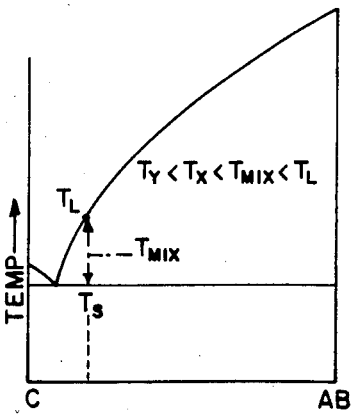

In FIGS. 2A, 2B and 2C, the binary diagrams A-C and B-C are reproduced as is the pseudobinary diagram formed by C-AB with the component AB. Inspection of these diagrams shos that the liquidus temperature of AB rises much more steeply than the liquidus temperatures in diagrams A-C and B-C. The desired composition for a product is shown by the cross in the ternary diagram ABC and in the pseudobinary diagram C-AB.

More specifically, referring now to FIGS. 2A, 2B, and 2C, in order to successfully achieve a rapidly solidified microdispersed alloy having the relatively large liquidus-solidus temperature interval indicated in FIG. 2C by the interval between $T_L$ and $T_S$, it is a finding of this invention that a melt mix reaction performed at $T_{mix}$ followed by rapid solidification yields a final alloy with a microdispersoid constituent. The double ended arrow between $T_L$ and $T_S$ refers to the temperature interval associated with an alloy having a predetermined proportion of solvent C and a predetermined proportion of solute compound AB. Here as can be seen $\Delta T=T_L-T_S$ and $\Delta T/T_L>0.2$.

As illustrated in FIG. 2A, the final alloy is made from a first starting alloy having a solvent C and a solute A in which, in the specific proportions indicated the first starting alloy has a liquidus temperature $T_x$. A second starting alloy as illustrated in FIG. 2B has a solvent C and a solute B which, in the indicated proportions, has a liquidus temperature $T_x$. As will be described in connection with FIG. 3, the starting alloys are mixed at a temperature, $T_{mix}$, which is set such that it is equal to or higher than the highest liquidus temperature of the starting alloys and lower than the liquidus temperature $T_L$ of the final alloy.

When the final alloy is produced in a mixing zone maintained at $T_{mix}$ and then later rapidly solidified, the rapid solidification takes place not from $T_L$ but rather from $T_{mix}$, such that the large liquidus-solidus temperature interval is largely avoided. This means that the particles start to form in a low atomic mobility environment (e.g. closer to $T_S$ or below) and thus cannot grow greater than the desired submicron size.

Figure 3A:
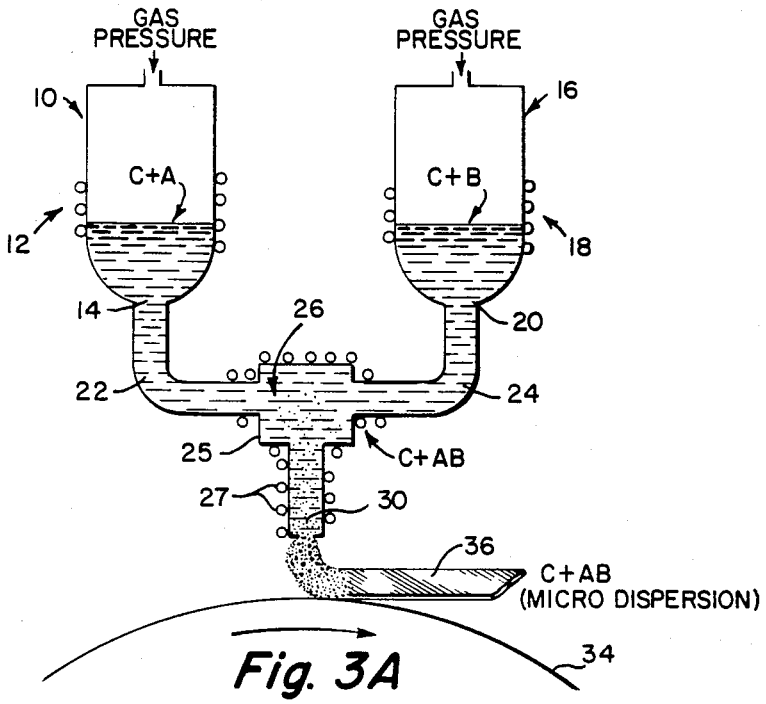
FIG. 3A is a schematic representation of one embodiment of the subject invention illustrating the melt mixing of starting alloys to provide a final alloy having a solvent matrix and a biphasic constituent the size of which is limited to produce a microdispersion of constituent particles in the solvent matrix upon rapid quenching at a melt spinning wheel and/or subsequent heat treatment.

Referring now to FIG. 3A, in one embodiment, one starting alloy, C+A, is melted in a vessel 10 by induction heating coils 12 so that a molten alloy exits vessel 10 at the bottom orifice 14 at a temperature at or above $T_x$. Likewise, a starting alloy C+B is formed in vessel 16 which is heated by induction heating coils 18 to a temperature at or above $T_y$, with the molten starting alloy exiting orifice 20. In order to minimize $T_{mix}$, the temperature for the vessels is maintained at or as close to the liquidus temperature of the highest melting alloy as possible.

Figure 3B:
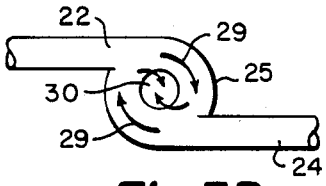
FIG. 3B is a diagrammatic illustration showing the mixing chamber of FIG. 3A.

Alloy streams in the form of jets are forced through conduits 22 and 24, respectively, to a mixing chamber 25 generally defining a mixing zone 26, with gas pressure being utilized in the ejection of the molten alloy through the conduits to the mixing chamber. Any of a variety of mixing chambers may be utilized which result in the starting alloys being turbulently mixed prior to the chemical reaction which takes place between the individual solutes of the starting alloys to produce the final solute, the constituent AB. In FIG. 3B one type of mixing chamber is shown to include a tangential flow turbulent mixing as shown by arrows 29. Referring back to FIG. 3A, the fully mixed liquid exits the mixing zone into a nozzle 30 which is optionally maintained at the temperature $T_{mix}$ by induction heating coils 27. In one embodiment, nozzle 30 is chosen to be of a length which assures that the complete chemical reaction has taken place between components A and B prior to ejection. In the embodiment illustrated in FIG. 3, the nozzle has a relatively wide aperture from which the solvent c and the solute in the form of the constituent AB are ejected towards a melt spinning wheel 34. Any chemical reaction which is continuing between the nozzle orifice and the top surface of the wheel, is rapidly terminated upon impingement with the wheel's surface which prevents the constituent particles from growing any further. Thereafter, a ribbon 36 is formed in which compound AB is microdispersed in the solvent C which now serves as a matrix for the microdispersion. The microdispersion particles can provide desirable properties, inter alia dispersion strengthening.

The desirable characteristics of the mixing zone and nozzle are first that substantially complete mixing takes place in the mixing zone and that the growth of any crystals nucleated in the mixing zone not exceed predetermined limits. This can be assured by providing sufficient turbulent mixing, while keeping the rate of heat extraction low, e.g. at $T_{mix}$. Secondly, a nozzle may be used to complete the mixing to continue the chemical reaction and to guide the flow out of the mixing zone. If used, it must either be short or heated to prevent freezing or growth. Alternatively, an orifice such as common in "melt drag" processes may be used in place of a nozzle.

Figure 4:
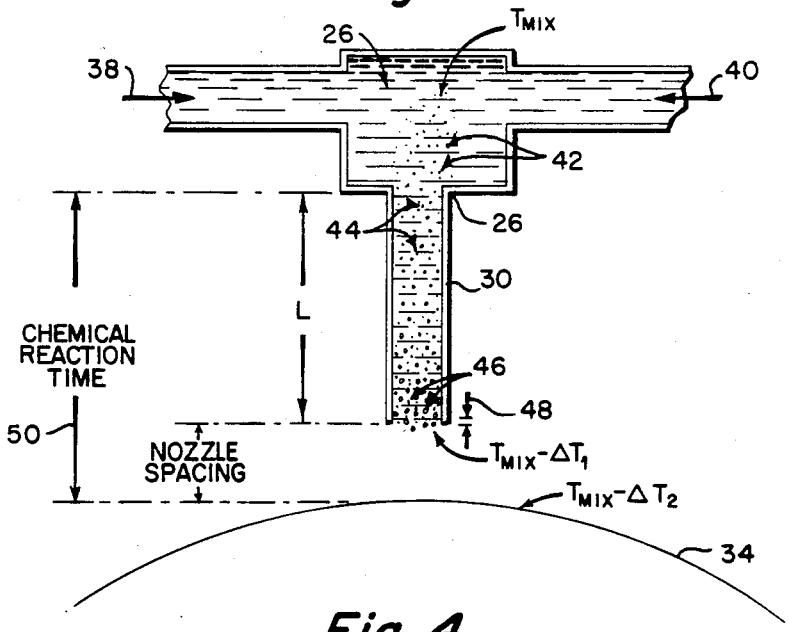
FIG. 4 is a schematic diagram of the process taking place in the mixing chamber and nozzle of FIG. 3A.

Referring now to FIG. 4, in one embodiment the liquid jets move in the directions of arrows 38 and 40 to mixing zone 26, with the size of the initial particles indicated by reference character 42 to be relatively small. As the chemical reaction takes place, these particles grow in size as indicated at 44, both due to the chemical reaction and due to crystal growth and/or agglomeration such that the solute compound increases in size as illustrated at 46, with a maximum desirable size for all types of mechanical property improvement being less than 10 microns, as indicated by double ended arrow 48. Preferably the maximum size is less than 0.1 microns. Should the nozzle not be maintained at $T_{mix}$, then it will be appreciated that the temperature drop, $\Delta T_1$, will be related to the length of the nozzle. In both cases, with the nozzle heated or unheated, the ultimate size of the solute compound is related to the length of the nozzle. For melt spinning apparatus involving a free flowing jet and a melt spinning wheel, there is another temperature drop between the nozzle orifice and the top surface of the wheel, here labeled $\Delta T_2$. This temperature drop is dependent on nozzle spacing from the wheel and is relatively insignificant both in terms of temperature drop and in terms of its effect on the agglomeration of the solute compound. As indicated by arrow 50, the chemical reaction can take place from initial mixing up to the time that the stream of solvent and solute impinge upon the wheel, at which time the chemical reaction ceases; only to be revived, if at all, by subsequent annealing.

It will be appreciated that the relative rates of alloy flowing from the two melting chambers to the mixing chamber is set according to the compositions of the component alloys C(A) and C(B) and the composition of the desired product alloy. The relative flow rates of the component alloys can be adjusted by varying the driving gas pressure for one or both chambers and by increasing or decreasing the length and diameter of the conduits 22, 24 leading to the mixing chambers.

If, in one embodiment, the required amount of alloy C(A) is substantially smaller than the amount of alloy C(B), the arrangement of the conduits and the mixing chamber may be configured asymmetrically, e.g. such that a stream C(A) is injected tangentially and turbulently into a flowing stream C(B).

Figure 5:
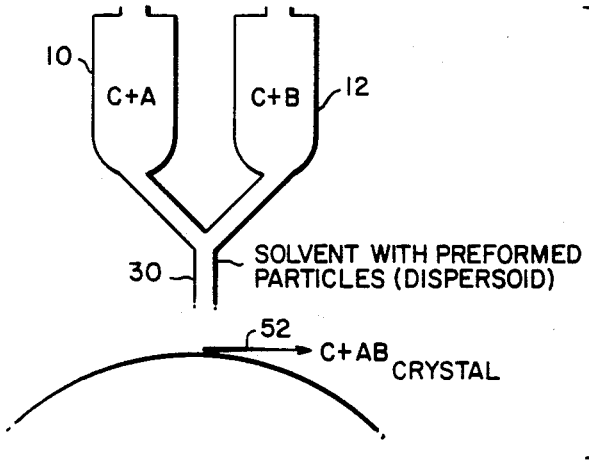
FIG. 5 is a schematic and diagrammatic illustration of an optimum melt mix reaction with the resultant ribbon having a matrix with the individual starting alloy components as a constituent of the final alloy in crystalline precipitate form.

FIG. 5 illustrates the processing situation with conditions suitable for complete chemical reaction, in which case the solvent with precipitate particles are formed in nozzle 30 such that the resulting ribbon ejected in the direction of arrow 52 is of the form $C+AB_{crystal}$.

Figure 6:
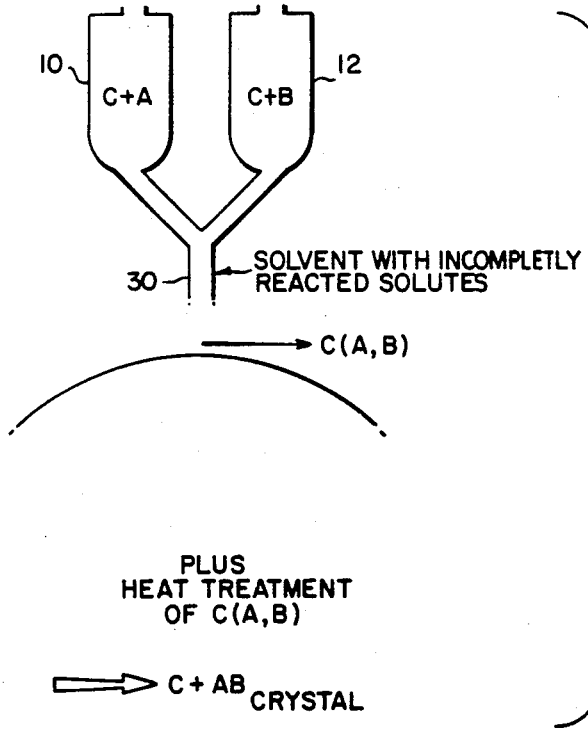
FIG. 6 is a schematic and diagrammatic representation of the subject process, indicating that heat treatment of the resultant product produces the desired result as illustrated in FIG. 5.

As shown in FIG. 6, with conditions for incomplete chemical reaction, there is a possibility that what is ejected from nozzle 30 will be in the form C(A,B) with the components A and B present as joint solutes in C but without the compound AB being microdispersed in crystalline form in the solvent. Should the ribbon be in the form C(A,B) then subsequent low temperature heat treatment in an annealing step can result in a final product $C+AB_{crystal}$. The degree of the formation of material having the form C(A,B) in nozzle 30 is dependent upon a number of factors, It is, however, possible to achieve material in the form $C+AB_{crystal}$ by providing suitably long dwell times after which no subsequent heat treatment is required. This invention is therefore not limited to a heat treatment process subsequent to the formation of the rapidly solidified material.

Figure 7:
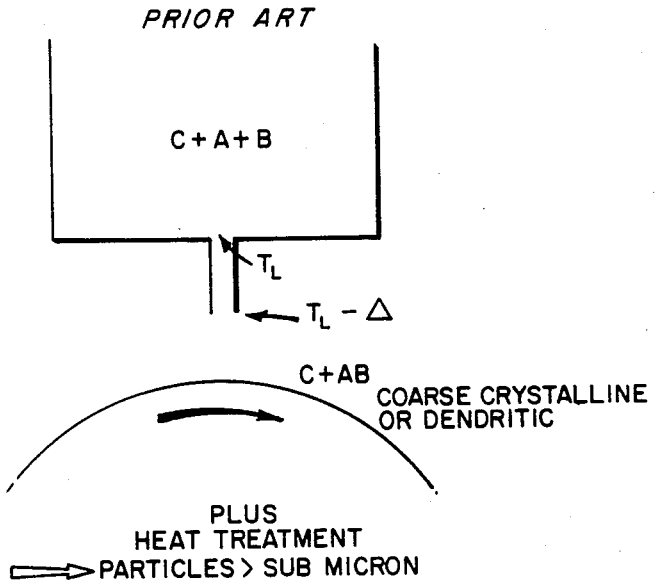
FIG. 7 is a schematic and diagrammatic representation of the result of a prior art process in which rapidly solidifying a preformed single liquid solution having the chemically reacted constituent in a solvent matrix is formed without the utilization of a melt mix reaction, whereby no microdispersion is formed even after subsequent heat treatment.

As illustrated in FIG. 7, should the liquid alloy be prepared in accordance with the prior art prior to rapid solidification as a single liquid solution, then dispersoid material would result having average particle diameters above the submicron level desired. One reason, as indicated above, is the relatively low effective cooling rate due to the passage from the relatively high liquidus temperature through the solidus temperature to the rapid quenching substrate temperature. A second reason is the larger-than-necessary cooling time interval for the above passage. A third reason is the higher atomic mobility or, alternatively expressed, lower melt viscosity at the relatively high liquidus temperature of the prior art process which favors dispersoid particle growth and ultimate large particle size. Thus, while in the past it has been impossible to create microdispersed products for many multiphase alloys, the subject melt mix reaction both limits the amount of time for the particles to grow or agglomerate, increases the effective cooling rate, and moves the solidification process into a temperature regime less favorable to particle growth, while favoring particle nucleation. All three effects limit the size of the final precipitate such that microdispersed multiphase ribbons can now be formed.

While a binary precipitate constituent is illustrated, the subject invention is not limited to binary constituent alloys, with multiphase constituent alloys being included within the scope of this invention. Likewise, single component or multiple component solvents are included within the scope of the invention, as are single phase or multiphase matrix materials resulting from the solidification process.

Figure 8:
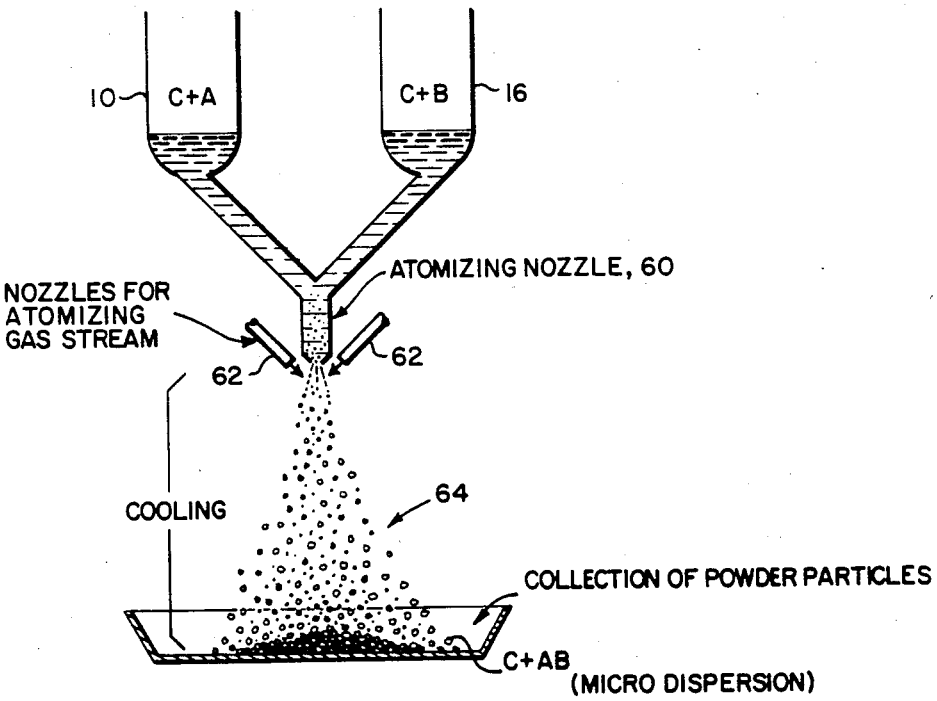
FIG. 8 is a schematic and diagrammatic illustration of the utilization of an atomizing system in the subject invention.

Referring now to FIG. 8, the rapidly solidified product may be achieved through the utilization of an atomizing nozzle 60 and nozzles 62 for providing atomizing gas streams, whereby rapid cooling is achieved desirably in a protective atmosphere. The powder 64 formed by the liquid droplets upon solidification consists of microdispersions in a solvent. It will be appreciated that the chemical reaction between solutes A and B can take place during the exit of the droplets from the atomizing nozzle such that the chemical reaction time is not as strictly controlled as in the melt spinning embodiments of FIGS. 3–6. However, adequate microdispersions of the AB constituent can be achieved in this manner with the microdispersed precipitates being in the submicron range.

Figure 9:
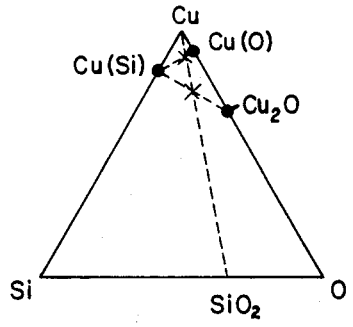
FIG. 9 is a representation of the composition triangle of the MMR system Cu-Si-O.
Figure 10:
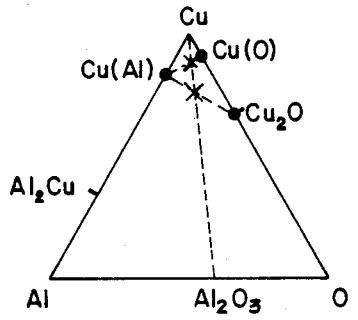
FIG. 10 is a representation of the composition triangle of the MMR system Cu-Al-O, presented to illustrate the formation of $Cu+Al_2O_3$.

Two representative MMR alloy systems are shown in FIGS. 9 and 10. FIG. 9 illustrates the reactions forming a silica dispersion in copper:

$Cu(Si+Cu(O)\rightarrow Cu+SiO_2$; and $Cu(Si)+Cu_2O\rightarrow Cu+SiO_2$.

The two reacting solutions for each of these reactions are marked by dots connected by dashed lines in the composition triangle. The resulting product mixtures $Cu+SiO_2$ are marked by crosses lying on the dashed lines.

FIG. 10 shows the reactions forming an alumina dispersion in copper, i.e. oxygen dispersion strengthened (ODS) copper:

$Cu(Al)+Cu(O)\rightarrow Cu+Al_2O_3$; and $Cu(Al)+Cu_2O\rightarrow Cu+Al_2O_3$.

Again, the reacting solutions as well as the reaction products are shown in the composition triangle by connected dots and crosses lying on the connecting lines. In the cases illustrated in FIGS. 9 and 10, the preferred amount of strengthening oxide is in the range of 4–5 volume percent oxide; these concentrations can be obtained readily by the reactions described.

Figure 11:
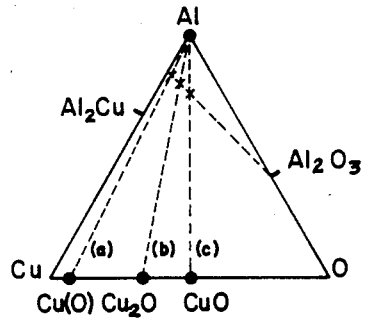
FIG. 11 is a representation of the composition triangle of the MMR system Cu-Al-O, presented to illustrate the formation of $Al(Cu)+Al_2O_3$.

FIG. 11 shows schematically the Al-Cu-O composition diagram to illustrate the case where solute$_1$ and solvent$_1$ are identical, resulting in reactions of the type:

$C+A(B)\rightarrow C(A)+BC$; or $C+AB\rightarrow C(A)+BC$.

Here the chemical reaction occurs between B and the solvent C; the reactive element B is contained as a dilute solute in A(B) in the reaction $C+A(B)\rightarrow C(A)+BC$ and as a component in the compound AB in the reaction $C+AB\rightarrow C(A)+BC$.

Examples are reactions that could be used to produce improved alloys of the "SAP" (sintered aluminum powder) type, consisting of a dispersion of $Al_2O_3$ in Al or an Al alloy, viz.:

(a) $Al+Cu(O)\rightarrow Al(Cu)+Al_2O_3$; or (b) $Al+Cu_2O\rightarrow Al(Cu)+Al_2O_3$; or (c) $Al+CuO\rightarrow Al(Cu)+Al_2O_3$.

The dashed lines marked (a), (b), and (c) correspond to the reactions (a), (b) and (c) given above and the composition dots at the ends of these line indicate the compositions of the melts to be mixed to achieve these three reactions and to give the compositions of the dispersed mixtures $Al(Cu)+Al_2O_3$ marked by crosses resulting from these reactions.

Specific examples of multiphase alloy systems along with processing parameters and temperatures are now described:

EXAMPLE 1

Using the subject melt mix reaction system, a copper alloy containing 1.5 atomic percent oxygen as solute was melt mix reacted with another copper alloy containing 10 atomic percent aluminum as solute utilizing the melt mix reaction $Cu(Al)+Cu(O)\rightarrow Cu(Al)+Al_2O_3$.

Both starting alloys were heated to a temperature $T_{mix}$ of 1070° C. before being ejected onto a copper wheel held at ambient temperature using a driving or gas pressure of 600 torr and an unheated nozzle having a diameter of 0.8 mm, nozzle length 2 mm, nozzle spacing from wheel 3 mm. The resulting ribbon consisted of a mixed Cu-Al-O alloy of the desired composition Cu(Al)+0.5 mole percent $Al_2O_3$ having a liquidus temperature in excess of 1100° C. Cu(Al) indicates that Al partially remains in solid solution in copper, resulting in an oxygen dispersion strengthened copper alloy that can be further modified by controlled low temperature heat treatments.

The excess of Al over that required for formation of the stoichiometric oxide serves to reduce the melting temperature, to facilitate completion of the reaction which is limited by the oxygen content, and to provide solid solution strengthening of the Cu matrix.

EXAMPLE 2

Using the subject melt mix reaction system, an Al base alloy $Al_{.90}Si_{.10}$, containing Si as solute and an Al alloy $Al_{.80}Mg_{.20}$ with Mg as solute, were melt mix reacted in the appropriate proportions to produce an alloy containing Al(Mg,Si) and $Mg_2Si$ according to the reaction $Al(Si)+Al(Mg)\rightarrow Al(Mg,Si)+Mg_2Si$ Here Al(Mg,Si) indicates that Mg and Si remain partially in solid solution in the Al matrix. This MMR process was conducted at $T_{mix}=570°$ C., i.e. at a temperature above the liquidus temperatures of the binary alloys but below the liquidus temperature, 630° C., of the resulting Al(Mg,Si)-$Mg_2Si$ alloy.

Following annealing after quenching, this alloy has smaller $Mg_2Si$ particles as a strengthening phase than an alloy prepared directly by melt spinning the final alloy from a temperature above its liquidus temperature and is thus more suitable for use as a structural alloy, e.g. for aircraft applications, than its non-MMR-produced counterpart or alloys prepared by conventional freezing.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A method of rapidly solidifying an alloy having a liquidus-solidus temperature interval incompatible with the formation of microdispersions by rapid solidification processes, the completely solidified alloy having a dispersion in a host matrix of a constituent of 10 nanometers to 0.1 micron, made from components which have been chemically reacted together, comprising the steps of:

providing a first starting alloy having a solvent and a chemically reactable component, said first starting alloy having a predetermined liquidus temperature;

providing a second starting alloy having a solvent and a component chemically reactable with said first mentioned component, said second starting alloy having a predetermined liquidus temperature;

melting said first and second starting alloys;

mixing said melted starting alloys in a melt mix reaction mixing zone at a temperature less than the liquidus temperature of the final alloy, the mixing temperature being at or above the higher of the liquidus temperatures of the starting alloys;

ejecting the melted alloys from a nozzle, the chemical reaction taking place either in a mixing zone or nozzle or both or later, but with the mixing time controlled by the mixing zone and nozzle to provide a sufficiently short dwell time until solidification such that the subsequent cooling period for the rapid solidification of the mixed starting alloys is short enough to provide a macroscopic homogeneous dispersion of submicron particles of the constituent in the host; and rapidly solidifying the ejected alloys to produce a completely solidified alloy having a dispersion of the constituent in the host which comprises said solvents.

2. The method of claim 1 wherein said completely solidified alloy is multiphasic.

3. The method of claim 1 wherein said completely solidified alloy is single phasic but capable of being converted into a multiphasic alloy by subsequent heat treatments.

4. The method of claim 1 wherein said first starting alloy is of the form ($metal_1$) and ($solute_1$) and wherein said second starting alloy is in the form ($metal_2$) and ($solute_2$), where $metal_1$ is one or more metals taken from the group Cr, Mn, Fe, Co, Ni, Cu, Ru, Rh, Pd, Ag, Os, Ir, Pt, and Au;

wherein $solute_1$ is one or more metals or metalloids capable of forming a stable compound with metalloids from $solute_2$;

wherein $metal_2$ is one or more metals possessing sufficient liquid solubility for $solute_2$ elements; and wherein $solute_2$ is one or more compound forming metalloids.

5. The method of claim 4 wherein $solute_1$ is taken from the group consisting of the metals Be, Mg, Ca, Y, rare earth metals, Th, Ti, Zr, Hf, V, Nb, Ta, Mo, W, Re, Al and the metalloids B and Si, $solute_2$ is taken from the group B, C, Si, N, P, Sb, O, S and $metal_2$ is taken from the group Cr, Mn, Fe, Co, Ni and Cu.

6. The method of claims 1 or 5 wherein said rapid solidification is performed by melt spinning.

7. The method of claims 1 or 5 wherein said rapid solidification is performed by atomization.

8. The method of claims 1 or 5 wherein the ratio of the liquidus-solidus temperature interval to the liquidus temperature of the final alloy is greater than 0.2.

9. A method of rapidly solidifying an alloy having a large liquidus-solidus temperature interval as compared to the liquidus temperature of the final alloy, the completely solidified alloy having a constituent in the submicron range, made from components which have been chemically reacted together, comprising the steps of:

providing a first starting alloy having a solvent and a chemically reactable component, said first starting alloy having a predetermined liquidus temperature;

providing a second starting alloy having a solvent and a component chemically reactable with said first mentioned component, said second starting alloy having a predetermined liquidus temperature;

melting said first and second starting alloys;

mixing said melted starting alloys in a melt mix reaction mixing zone at a temperature less than the liquidus temperature of the final alloy, the mixing temperature being at or above the higher of the liquidus temperatures of the starting alloys;

ejecting the melted alloys from a nozzle, the chemical reaction taking place either in the mixing zone or nozzle or both, with the mixing time controlled by the mixing zone and nozzle to provide a sufficiently short dwell time such that the subsequent cooling period for the rapid solidification of the mixed starting alloys is short enough to provide a macroscopic homogeneous dispersion of submicron particles of the constituent in the host; and rapidly solidifying the ejected alloys to produce a completely solidified alloy.

10. The method of claim 9 wherein the ratio of the liquidus-solidus temperature interval to the liquidus temperature of the final alloy is greater than 0.2.

11. The method of claim 9 wherein said rapid solidifying step includes the step of ejecting the mixed alloys onto a melt spinning wheel.

12. The method of claim 9 wherein said rapid solidifying step includes the step of atomizing said mixed alloys.

13. The method of claim 9 wherein the said solvents are the same.

14. The method of claim 9 wherein said final alloy is multiphasic.

15. The method of claim 10 and further including the step of heat treating the completely solidified alloy after rapid solidification to form a precipitate of the constituent in the host matrix of the completely solidified alloy.

16. A method of rapidly solidifying an alloy having a predetermined liquidus-solidus temperature interval so as to produce a dispersion of a submicron constituent in a final alloy, the constituent having been made from components which have been chemically reacted together, comprising the steps of:

providing a first starting alloy having a chemically reactable component, said first starting alloy having a predetermined liquidus temperature;

providing a second starting alloy having a component chemically reactable with said first mentioned component, said second starting alloy having predetermined liquidus temperature;

melting said first and second starting alloys;

mixing said melted starting alloys in a melt mix reaction mixing zone at a temperature less than the liquidus temperature of the final alloy, the mixing temperature being at or above the higher of the liquidus temperatures of the starting alloys;

ejecting the melted alloys from a nozzle, the chemical reaction taking place either in the mixing zone or nozzle or both, with the mixing time controlled by the mixing zone and nozzle to provide a sufficiently short dwell time such that the subsequent cooling period for the rapid solidification of the mixed starting alloys is short enough to provide a homogeneous dispersion of submicron particles of the constituent in the host; and rapidly solidifying the ejected alloys to produce a completely solidified alloy.

17. The method of claim 16 wherein said first and second alloys are in the form of a liquid solution based on a solvent.

18. The method of claim 16 wherein said first and second alloys are in the form of molten compounds.

19. The method of claim 16 wherein the components and the chemical reaction are given by the formula: $Al(Si)+Al(Mg)\rightarrow Al+Mg_2Si$.

20. The method of claim 16 wherein the components and the chemical reaction are given by the formula: $Al(Ti)+Al(B)\rightarrow Al+TiB_2$.

21. The method of claim 14 wherein the components and the chemical reaction are given by the formula: $Al+Cu(O)\rightarrow Al(Cu)+Al_2O_3$.

22. The method of claim 16 wherein the components and the chemical reaction are given by the formula: $Al+Ni(O)\rightarrow Al+Al_3Ni+Al_2O_3$.

23. The method of claim 16 wherein the components and the chemical reaction are given by the formula: $Cu(Al)+Cu(O)\rightarrow Cu+Al_2O_3$.

24. The method of claim 16 wherein the components and the chemical reaction are given by the formula: $Cu(Al)+Ni(O)\rightarrow(Cu,Ni)+Al_2O_3$.

25. The method of claim 16 wherein the components and the chemical reaction are given by the formula: $(Cu,Ni)(Nb)+Cu(Ge,Al)\rightarrow Cu(Ni)+Nb_3(Ge,Al)$.

26. The method of claim 16 wherein the components and the chemical reaction are given by the formula: $Cu(Si)+Cu(O)\rightarrow Cu+SiO_2$.

27. The method of claim 16 wherein the components and the chemical reaction are given by the formula: $Ni(Th)+Ni(O)\rightarrow Ni+ThO_2$.

28. The method of claim 16 wherein the components and the chemical reaction are given by the formula: $Ni(Al)+Ni(O)\rightarrow Ni+Al_2O_3$.

29. The method of claim 16 wherein the components and the chemical reaction are given by the formula: $Ni(Al)+(Ni,Cu)(O)\rightarrow Ni(Cu)+Al_2O_3$.

30. The method of claim 16 wherein the components and the chemical reaction are given by the formula: $Ni(B)+Ni(Mo)\rightarrow Ni+Mo_xB$.

31. The method of claim 16 wherein the components and the chemical reaction are given by the formula: $Ni(B)+Ni(Ti)\rightarrow Ni+TiB_2$.

32. The method of claim 16 wherein the components and the chemical reaction are given by the formula: $Ni(Al)+Ni(Nb)\rightarrow Ni+Nb_3Al$.

33. The method of claim 16 wherein the components and the chemical reaction are given by the formula: $Co(C)+Co(W)\rightarrow Co+Wc$.

34. The method of claim 16 wherein the components and the chemical reaction are given by the formula: $Co(C)+Co(Mo)\rightarrow Co+MoC$.

35. The method of claim 16 wherein the components and the chemical reaction are given by the formula: $Fe(C)+Fe(Mo,W)\rightarrow Fe+(Mo,W)C$.

36. The method of claim 16 wherein the components and the chemical reaction are given by the formula: $Ag(Cd)+Cu(O)\rightarrow Ag(Cu)+CdO$.

37. The method of claim 16 wherein the components and the chemical reaction are given by the formula: $Ag(Bi)+Cu(O)\rightarrow Ag(Cu)+Bi_2O_3$.

38. The method of claim 16 wherein the components and the chemical reaction are given by the formula: $Pb(Sb)+Pb(In)\rightarrow Pb+InSb$.

39. The method of claim 16 wherein the components and the chemical reaction are given by the formula: $Si(Th)+Si(O)\rightarrow Si+ThO_2$.

40. The method of claim 16 wherein said first starting alloy is of the form ($metal_1$) and ($solute_1$) and wherein said second starting alloy is in the form ($metal_2$) and ($solute_2$), where $metal_1$ is one or more metals taken from the group Cr, Mn, Fe, Co, Ni, Cu, Ru, Rh, Pd, Ag, Ox, Ir, Pt, and Au;

wherein $solute_1$ is one or more metals or metalloids capable of forming a stable compound with metalloids from $solute_2$;

wherein $metal_2$ is one or more metals possessing sufficient liquid solubility for $solute_2$ elements; and wherein $solute_2$ is one or more compound forming metalloids.

41. The method of claim 40 wherein $solute_1$ is taken from the group consisting of the metals Be, Mg, Ca, Y, rare earth metals, Th, Ti, Zr, Hf, V, Nb, Ta, Mo, W, Re, Al and the metalloids B and Si, $solute_2$ is taken from the group B, C, Si, N, P, Sb, O, S, and $metal_2$ is taken from the group Cr, Mn, Fe, Co, Ni and Cu.

42. The method of claim 16 wherein the components and the chemical reaction are given by the formula: $Ni(y)+Ni(o)\rightarrow Ni+Y_2O_3$.

* * * * *